United States Patent [19]

Peterson

[11] 4,140,257

[45] Feb. 20, 1979

[54] TRASH BAG SLING

[76] Inventor: Marjorie A. Peterson, 3537 Pennsylvania Ave., East Chicago, Ind. 46312

[21] Appl. No.: 826,852

[22] Filed: Aug. 22, 1977

[51] Int. Cl.[2] ..... B65D 63/18

[52] U.S. Cl. ..... 224/49; 206/804; 220/404

[58] Field of Search ..... 294/74, 75, 77; 150/1, 150/50; 206/804; 215/100 R; 220/17, 63 R, 65; 224/45 P, 45 C, 45 N, 49, 55, 58; 248/95, 97, 99

[56] References Cited

U.S. PATENT DOCUMENTS

| | | | |
|---|---|---|---|
| 1,736,192 | 11/1929 | Easton | 220/17 |
| 1,971,642 | 8/1934 | Champlin | 248/97 |
| 2,188,111 | 1/1940 | Grandinetti | 220/65 |
| 2,464,069 | 3/1949 | Benson | 150/50 X |
| 2,500,466 | 3/1950 | Myers | 220/65 X |
| 3,084,966 | 4/1963 | Higgins | 294/77 |
| 3,779,156 | 12/1973 | Race | 220/63 R X |
| 3,836,037 | 9/1974 | Bass | 248/99 X |

*Primary Examiner*—Johnny D. Cherry
*Attorney, Agent, or Firm*—Sabin C. Bronson

[57] ABSTRACT

A sling is provided for lifting a filled trash bag out of a trash container without the bag being ruptured by the weight of the trash therein. The sling comprises two lengths of strong strap-like material which cross each other at their midpoints and are attached together. A reinforcing plate is attached over the intersecting portion of the staps. This plate is made of relatively rigid waterproof plastic. This portion of the sling is placed in the bottom of a trash container with the ends of the straps draped up and hooked over the upper open end of the container to hold the straps in place. The trash bag is placed in the container with the side walls of the bag extending up to the open end of the container. A cover is usually provided with these containers but it is omitted from the drawing.

1 Claim, 3 Drawing Figures

TRASH BAG SLING

BACKGROUND AND SUMMARY OF THE INVENTION

Most everyone having a home and yard with grass to mow and trash to carry out to a waste receptacle having a waste receiving bag therein, have had the experience, when the bag is filled, of having the bag break when attempting to lift the bag out of the container to be picked up by the trash collector. This is not a very pleasant experience.

My invention overcomes this difficulty and provides a sling surrounding the bag so that when filled the lifting force is on the sling with no strain on the bag in lifting it out of the container.

BRIEF DESCRIPTION OF THE DRAWINGS

Referring now to the accompanying drawings forming part of this application, and wherein like reference characters indicate like parts.

DESCRIPTION OF THE PREFERRED EMBODIMENT

Figure 1:
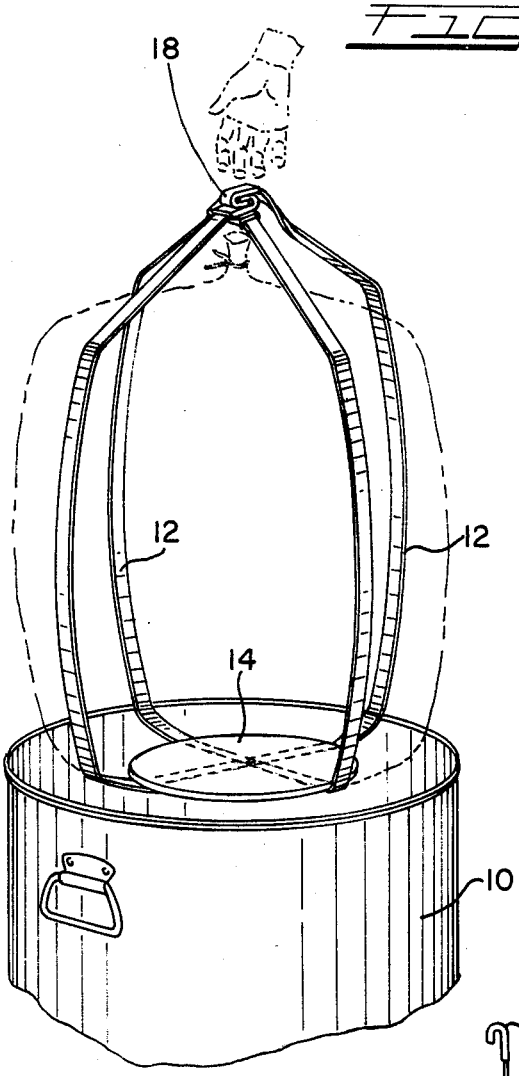
FIG. 1 is a perspective view of the upper part of a trash container with my invention shown as being lifted out of the container and with the bag therewithin but shown in dotted lines.

Referring now in detail to the drawings, there is shown at 10, in FIG. 1, the upper end of an ordinary trash container such as is commonly used by every household and located adjacent an alley or place for the collection of trash by municipal trash collectors. It is usually a container of about twenty gallon capacity, and for which there are available plastic bags of similar capacity to be placed in the container, and in which the trash is placed as it accumulates from day to day in the household. When this bag is filled, the collector takes hold of the upper end of the bag and lifts the bag out of the container and places it in the garbage truck. In this process all too frequently the bag splits open due to the weight of the contents, and then there is an awful mess to clean up.

Figure 2:
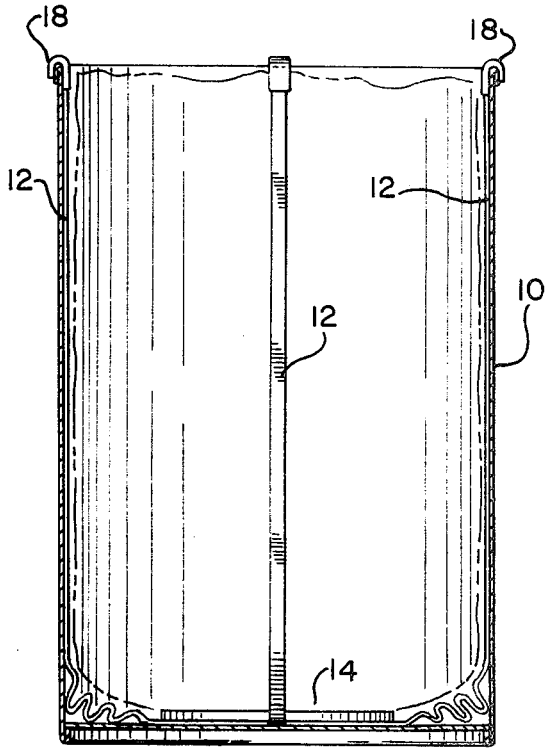
FIG. 2 is a central vertical cross sectional view of the container and with the sling therein.
Figure 3:
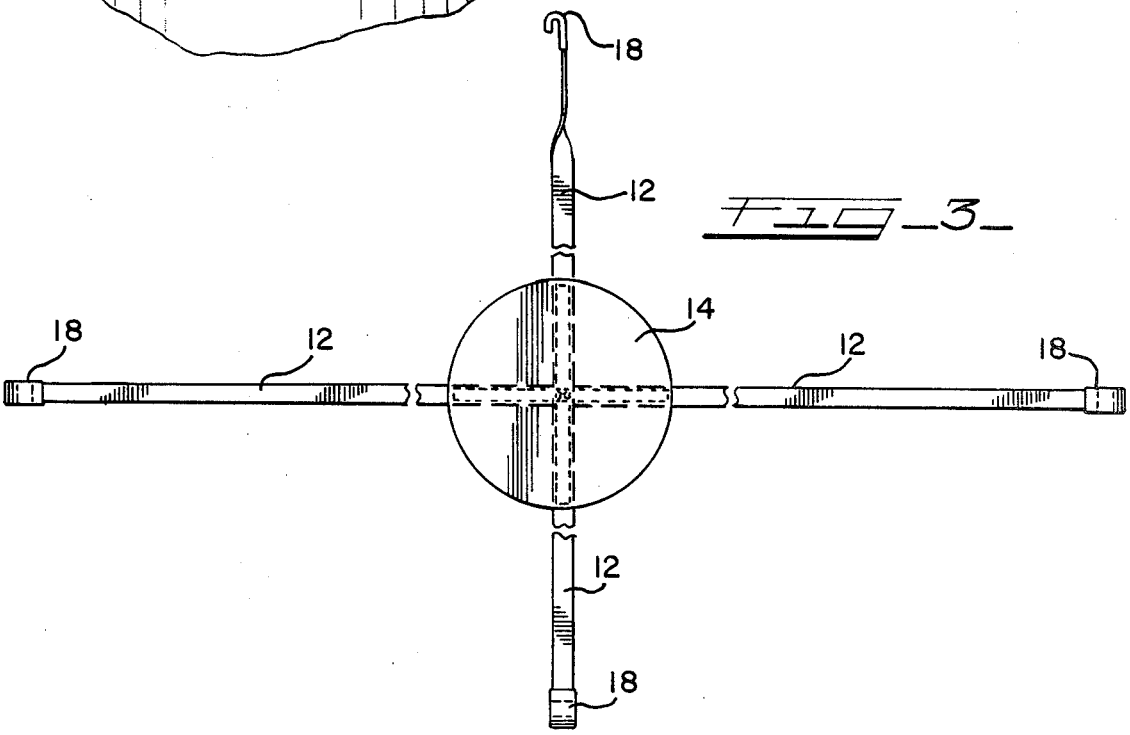
FIG. 3 is a top plan view of the intersecting parts of the sling, partly broken away.

To overcome this difficulty there is provided a pair of strong straps 12 which are securely joined together at right angles at their midpoint as shown in FIG. 3. At the point of intersection there is a heavy plastic disc or plate 14, about the size of a large pie plate, which is securely attached to the straps 12 as shown in FIG. 3. These straps, thus joined together, are placed into the container with the plate 14 and intersecting portions of the straps in the bottom of the container as shown in FIG. 2. The straps then extend over the bottom to the sides of the container thence up the sides and are hooked over the top of the sides.

A plastic bag is placed in the container as shown in FIG. 2 with the straps on the outside of the bag.

Each strap is in length approximately twice the depth of the container so that there will be ample length of strap to hook together, when the bag is full as shown in FIG. 1, and then lifted out of the container for disposal in the garbage truck.

The free ends of the straps 12 are each dipped in a liquid plastic material and then, with a heated die, formed into a relatively rigid hook 18, which hooks over the upper edge of the container 10 when the sling is in the container. The strap lengths are sufficient so that when the bag is filled the upper ends of the straps may be pulled toward each other across the top of the bag and the hooks at the end of the straps hooked together. The hooked ends of the straps may then be used as a handle in lifting the trash bag from the container, as indicated in dotted lines in FIG. 1. Of course the hook at one end of each of the straps would have to be turned oppositely to its meeting hook so as to be hooked together as shown in FIG. 1.

I claim:

1. A sling consisting of a pair of substantially equal lengths of strong flexible straps, said straps being positioned across each other at their midlengths and securely fastened together, said straps being adapted to be positioned with their intersecting portions in the bottom of a trash container or the like, hooks formed at the ends of said straps which may hook over the upper edge of said container to hold the straps in place, so that a trash bag may be placed within said container and on said straps, during filling of said bag, and then when filled said hooks may be hooked together to form a handle to lift the bag from the container.

* * * * *